US011052687B2

(12) United States Patent
Daniels et al.

(10) Patent No.: US 11,052,687 B2
(45) Date of Patent: Jul. 6, 2021

(54) SYSTEM AND METHOD FOR ANALYZING THE SURFACE OF A THREE-DIMENSIONAL OBJECT TO BE PRINTED BY A PRINTHEAD MOUNTED TO AN ARTICULATING ARM

(71) Applicant: Xerox Corporation, Norwalk, CT (US)

(72) Inventors: Marc D. Daniels, Webster, NY (US); Husein Naser Rashed, Webster, NY (US); Jonathan R. Ireland, Lancaster, PA (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/452,960

(22) Filed: Jun. 26, 2019

(65) Prior Publication Data

US 2020/0406649 A1 Dec. 31, 2020

(51) Int. Cl.
*B41J 25/00* (2006.01)
*B41J 3/407* (2006.01)

(52) U.S. Cl.
CPC ..... *B41J 25/001* (2013.01); *B41J 3/4073* (2013.01)

(58) Field of Classification Search
CPC ..... B41J 25/001; B41J 3/4073; B41J 3/40731
See application file for complete search history.

(56) References Cited

U.S. PATENT DOCUMENTS 6,360,656 B2 * 3/2002 Kubo ..... B41J 2/01 101/35
6,578,276 B2 * 6/2003 Patton ..... B41J 2/01 101/35
8,123,350 B2 2/2012 Cannell et al.
8,511,782 B2 * 8/2013 Chang ..... B41J 29/38 347/16
2013/0015596 A1 1/2013 Mozeika et al.
2013/0314460 A1 11/2013 Orr
2017/0253024 A1 9/2017 LaCaze et al.

FOREIGN PATENT DOCUMENTS

WO 2016/097932 A1 6/2016
WO 2019/041027 A1 3/2019

OTHER PUBLICATIONS

European Search Report corresponding to European Patent Application No. EP 20 18 1288, dated Nov. 25, 2020 (8 pages).

* cited by examiner

*Primary Examiner* — Thinh H Nguyen
(74) *Attorney, Agent, or Firm* — Maginot Moore & Beck LLP

(57) ABSTRACT

An object printer is configured to generate a three-dimensional map of a surface of an object to be printed and determine which areas in the three-dimensional map can be printed by a printhead movable in three-dimensional space. Areas can be printed when the printhead is positioned opposite an area where no inkjet in the printhead is closer than a minimum distance for accurate ink drop placement and all of the features in the area are within a maximum distance for accurate ink drop placement from the printhead. The areas that cannot be printed are deleted from the map and the map is displayed so a user can select where an ink image is to be formed on the object. The printer then operates an articulated arm to move the printhead opposite the surface at positions corresponding the selected area and operates the printhead to form the ink image.

4 Claims, 4 Drawing Sheets

SYSTEM AND METHOD FOR ANALYZING THE SURFACE OF A THREE-DIMENSIONAL OBJECT TO BE PRINTED BY A PRINTHEAD MOUNTED TO AN ARTICULATING ARM

TECHNICAL FIELD

This disclosure relates generally to devices that produce ink images on three-dimensional objects by ejecting ink drops from printheads, and more particularly, to devices that form images on three-dimensional objects by ejecting ink drops from printheads that maneuver through three-dimensional space.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

Printers configured to eject ink drops onto the surface of three-dimensional (3D) objects are known. In some of these printers, the printhead is mounted to a robotic or articulated arm so the printhead can be maneuvered in three-dimensional space. In these printer, the size, shape and position of the surface areas to be printed are not known before the printing operation begins. Objects can vary in size from print job to print job. For example, items such as athletic apparel generally have a similar shape but they come in different sizes. Other objects may have the same size, such as a baseball glove, but they are frequently manufactured in a way that produces variations in the size of the area to be printed. For example, the printable area for a junior size fielder's glove is known to have a surface large enough to accommodate a custom logo, but each individual glove, whether hand or machine sewn, is prone to inconsistencies from one glove to the next. Such objects have unprintable areas, such as the areas between the fingers of the gloves. The variety of objects that can be printed by such a printer also presents problems for operating the printer to ensure the ink images are properly formed and positioned on the surface of these different objects with varying contours and sizes.

Other aspects of the printing system also compound the problems for reliably printing 3D objects. In a six-axis robotic printer, the printhead has a limited range of motion. Also, the faceplate of the printhead is flat and has a length and width sufficient to accommodate the array of inkjet nozzles in the faceplate. The faceplate has to be able to be positioned within a predetermined gap to the object surface to be printed so the ink drops land where they should for image formation. Typically, the minimum gap for accurate placement of an ink drop is about 1 mm from the surface of flat objects. The maximum gap for accurate placement of an ink drop, however, is not an absolute because it depends upon several factors. Among these factors are the type of ink, the ink's viscosity, its temperature, the velocity and mass of the ink drops, and any motion in the air surrounding the area to be printed. Ink viscosity and temperature dictate print parameters, such as the firing frequencies and wave form voltages used to operate the actuators in the inkjets. Thus, the maximum print gap distance is typically no more than a few to several millimeters. Being able to identify the printing parameters for different sizes of printheads printing with different types of inks on a wide range of object types and sizes would be beneficial.

SUMMARY

A method of 3D object printer operation enables a variety of object types and sizes to be printed by a printer having a printhead mounted to a robotic arm having six degrees of freedom. The method includes generating topographical data with a scanner positioned opposite a surface of an object to be printed, receiving with a controller the topographical data from the scanner, determining with the controller using the topographical data whether the surface of the object can be printed by a printhead moved in a three-dimensional space to a position opposite the surface of the object, and operating the printhead with the controller to form an ink image on the surface of the object when the controller determines the surface of the object can be printed by the printhead and has moved the printhead to the position opposite the surface of the object.

A 3D object printer implements the method that enables a variety of object types and sizes to be printed by a printer having a printhead mounted to a robotic arm having six degrees of freedom. The inkjet printer includes a printhead configured for movement in three-dimensional space, a scanner configured to generate topographical data of a surface of an object opposite the scanner, and a controller operatively connected to the printhead and the scanner. The controller is configured to receive the topographical data from the scanner, determine using the topographical data whether the surface of the object can be printed by the printhead when the printhead is opposite the surface of the object, and operate the printhead when the printhead is opposite the surface of the object to form an ink image on the surface of the object when the controller determines the surface of the object can be printed by the printhead.

BRIEF DESCRIPTION OF THE DRAWINGS

The foregoing aspects and other features of a system and method that enable a variety of object types and sizes to be printed by a printer having a printhead mounted to a robotic arm having six degrees of freedom are explained in the following description taken in connection with the accompanying drawings.

DETAILED DESCRIPTION

Figure 1:
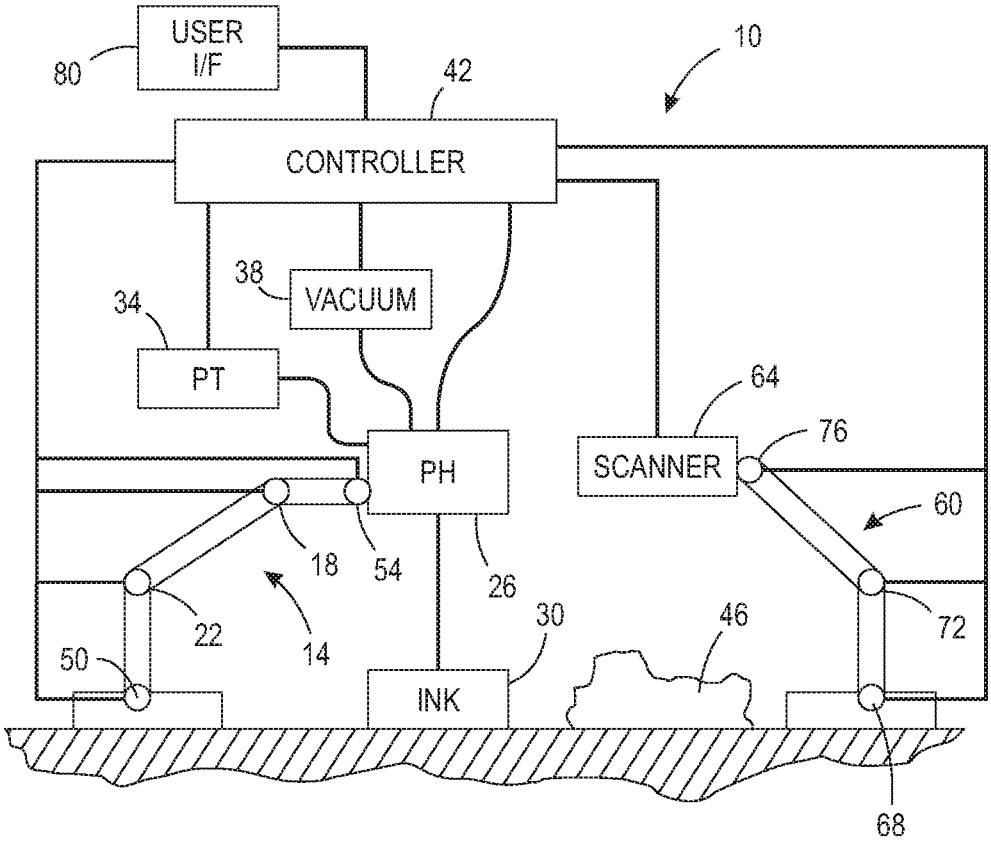
FIG. 1 is a schematic drawing of an inkjet printer having an articulated arm that moves a printhead through three-dimensional space to print ink images on a variety of 3D object types and sizes accurately and reliably.

For a general understanding of the environment for the system and method disclosed herein as well as the details for the system and method, reference is made to the drawings.

In the drawings, like reference numerals have been used throughout to designate like elements. As used herein, the word "printhead" encompasses any apparatus that ejects a marking material to produce ink images on the surfaces of objects.

FIG. 1 illustrates an inkjet printer 10 having an articulated arm 14 that is configured with a printhead 26 to form ink images on the surfaces of objects, such as object 46, located in the vicinity of the printhead. To perform an analysis of the surface area of the object 14, another articulated arm 60 that is configured with a scanner 64 to generate a graph of the surface of the object 46 that is analyzed by the controller 42 as described more fully below to identify an area of the object for printing and the printing parameters necessary for performing the print job. In other embodiments, the scanner 64 is mounted to a fixed position at a perspective that enables the scanner to generate a depth map of a commonly printed surface of an object. The scanner can be a digital camera or it can be a sensing device that generates a surface map of an object that indicates the undulations in the surface of the object. Such sensing devices include laser, lidar, ultrasound surface mapping devices or the like. The articulated arms 14 and 60 can be, for example, a six-axis robotic arm, such as the Epson C4 robotic arm available from Epson America, Inc. of Long Beach, Calif. The articulated arm 14 is configured for movement that enables the printhead to move opposite all of the sides, top, and back of the object 46 but the drawing scale does not comport with this range to simplify the figure. The articulated arm 14 includes servos 18, 22, 50, and 54 that join arm segments to one another and these servos are configured to move the arm segments vertically, horizontally, and combinations of these directions. Additionally, the servo 54 is operated to tilt and rotate the printhead 26 to produce changes in the yaw, roll, and pitch of the printhead. As used in this document, the term "vertical" means a direction of movement that changes the gravitational potential of the component or portion of the component being moved. As used in this document, the term "horizontal" means a direction of movement that maintains the gravitational potential on the component or portion of the component at the gravitational potential it possessed prior to the movement. When the printhead is held at a horizontal position, the longitudinal axis of the printhead face is at a same gravitational potential through the printhead. Three orthogonal axes centered in the printhead then define an X axis that is corresponds to the longitudinal axis, a Y axis that is at the same gravitational potential of the X axis and forms a horizontal plane with the X axis, and a Z axis that is perpendicular to both the X and Y axes and corresponds to a change in the gravitational potential of the printhead or a portion of the printhead. Thus, "yaw" is defined as rotation of the printhead about the Z axis in the X-Y plane, "pitch" is defined as rotation about X axis in the Y-Z plane, and "roll" is defined as Y axis in the X-Z plane. The controller 42 generates signals that operate the servos to move the arm segments of the articulated arm 14 and to tilt and roll the printhead to position the printhead 26 at various locations and orientations opposite the object 46.

In systems where a printhead remains in a horizontal orientation at a predetermined distance above the free surface of the ink in a fixedly mounted ink reservoir, vacuum control is not necessary to maintain an appropriate meniscus in the inkjets of the printhead since the hydrostatic pressure in the printhead remains relatively constant. Where the printhead moves with respect to the level of the ink in the ink reservoir of the ink delivery system 30, which is fixedly mounted with reference to the base of the robotic arm, then more robust control of the meniscus is required.

The system 10 shown in FIG. 1 moves the printhead 26 relative to the ink level in the ink reservoir of the ink delivery system 30. To address pressure changes in the printhead arising from this movement, a vacuum source 38 is operatively connected to the manifold internal to the printhead 26 or to the head space in the reservoir of the ink delivery system 30 to maintain the negative ink meniscus in the nozzles of printhead 26 while the printhead is being maneuvered through three-dimensional space by the articulated robotic arm 14. The controller 42 operates the vacuum system 38 to keep the pressure within the manifold of the printhead 26 at a predetermined value by using the signal generated by pressure transducer 34. Pressure transducer 34 is configured to generate a signal indicating the ink pressure within the manifold of the printhead 26. The pressure transducer can be mounted to or within the printhead 26 or operatively connected to the manifold by a pneumatic tube or the like.

As the printhead moves, the vacuum level is adjusted for acceleration of the printhead and ink in the supply tubes in any direction that produces hydraulic water hammer to occur within the printhead and for maintaining the meniscus when elevation changes occur. A the controller is configured to implement a feed forward control loop that preempts pressure changes by beginning the vacuum control before the printhead movement occurs because the controller is using robotic arm control data to operate the robotic arm so the controller uses the path data and is able to identify the dynamic forces acting on the ink in the supply tubes and printhead so it can operate the vacuum source 38 to reduce the overshoot and lag time in the vacuum control. For example, the controller can select a plurality of positions along the path at predetermined increments of vertical displacement and operate the vacuum using a vacuum value associated with the first selected position and then as the printhead nears that position begin operating the vacuum with another vacuum value associated with a next selected position along the path. This operation of the vacuum continues until the last position in the path is reached.

The articulated arm 60 in FIG. 1 is configured for movement that enables the scanner to move opposite all of the sides, top, and back of the object 46 but the drawing scale does not comport with this range to simplify the figure. The articulated arm 60 includes servos 68, 72, and 76 that join arm segments to one another and these servos are configured to move the arm segments vertically, horizontally, and combinations of these directions. Additionally, the servo 76 is operated to tilt and rotate the scanner 64 to produce changes in the yaw, roll, and pitch of the printhead. These terms have been defined above with reference to the articulated arm 14. The controller 42 generates signals that operate the servos to move the arm segments of the articulated arm 60 and to tilt and roll the scanner 64 so the scanner is at various locations and orientations opposite the surface of the object 46. The signals generated by the scanner 64 indicate the topography of the surface of the object 46 opposite the scanner and within its field of vision. The signals sent to the servos of the articulated arm 60 enable the controller 42 to identify the positions of the surface features in the three-dimensional space opposite the scanner. The scanner 64 can be a Keyence laser scanner, available from Keyence Corporation of America, Itasca, Ill., or its equivalent. The scanner can implement other non-contact scan technology, including an array of fixed position cameras or sensors located above the 3D object, or that uses LASER, LIDAR, or ultrasonic sensors that are movably mounted on rails or a robotic arm that are maneuverable above the object. These sensors can be mounted to a robotic arm separate from the one on which the printhead is mounted, as shown in FIG. 1, or they can be mounted to the same robotic arm to which the print head is mounted. Additionally, the scanner can be a hand held 3D LASER scanner, such as the VIUscan 3D laser scanner available from Creaform USA Inc. of Irvine, Calif.

The controller 42 can be implemented with general or specialized programmable processors that execute programmed instructions. The instructions and data required to perform the programmed functions can be stored in memory associated with the processors or controllers. The processors, their memories, and interface circuitry configure the controllers to perform the operations previously described as well as those described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits. During printing, image data for an image to be produced are sent to the controller 42 from either a scanning system or an online or work station connection for processing and generation of the printhead control signals output to the printhead 26. Additionally, the controller 42 uses signals from the pressure transducer 34 to operate the vacuum 38 to maintain the negative ink meniscus at the printhead as it is moved during printing of the object.

Figure 2:
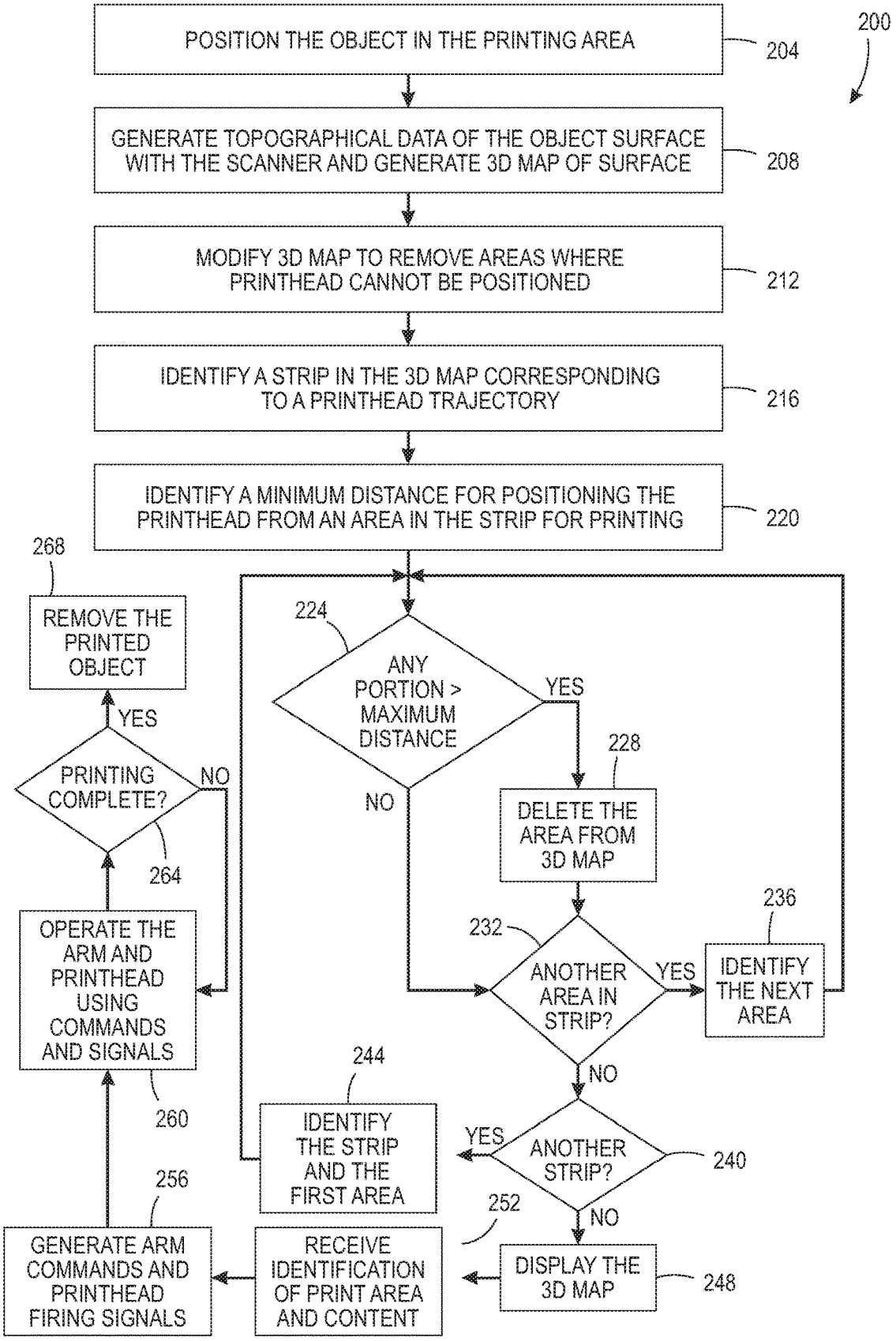
FIG. 2 is a flow diagram of a process for operating the printer of FIG. 1 to identify an area for image formation on an object in the printer.

A process 200 for identifying surface area of the object that can be reached by the printhead 26 and printed is shown in FIG. 2. In the discussion below, a reference to the process 300 performing a function or action refers to the operation of a controller, such as controller 42, to execute stored program instructions to perform the function or action in association with other components in the printer. The process 200 is described as being performed by the printer 10 of FIG. 1 for illustrative purposes.

Prior to printing an image on the object 46, the object to be printed is placed within the printing area of system 10 (block 204). The controller 42 operates the scanner 64 to generate topographical data corresponding to the object's surface and generates a three-dimensional map of the object surface using the topographical data received from the scanner (block 208). If the scanner is mounted to an articulated arm as shown in FIG. 1, the controller also operates the servos of the articulated arm 60 to move the scanner over the surface area of the object 46 as the scanner is operated. As used in this document, the term "scanner" means any device that generates topographical data that can be used to generate a three-dimensional map of an object's surface. As used in this document, the term "topographical data" means data that either directly provides a three-dimensional map of an object's surface or data that can be converted into a three-dimensional map that identifies the undulations in a surface. As used in this document, the term "three-dimensional map of an object surface" means a digital representation of an object surface that depicts heights and depths of the undulations in an object's surface. The three-dimensional (3D) map is then modified by eliminating the areas in the map that are outside of the range of the articulated arm and printhead (block 212).

With further reference to FIG. 2, a strip on an edge of the modified 3D map is then identified that corresponds to a width of the printhead 26 as the process moves a virtual printhead over the object in a process direction (block 216). As used in this document, the term "virtual printhead" means a data representation of the printhead to be used for printing that corresponds to the dimensions of the inkjet array in the printhead and movement of the printhead with respect to the surface of the object to be printed. As used in this document, the term "strip" means a plurality of contiguous areas in the process direction in the three-dimensional map of the surface of the object over which the printhead can be placed with each area corresponding to the dimensions of a printhead faceplate as the printhead is moved over the areas to print a portion of an image in each area. As used in this document, the term "process direction" means the direction of movement of the printhead as it ejects ink onto the object and the term "cross-process direction" means an axis that is perpendicular to the process direction in the plane of the process direction movement. The controller then identifies a minimum distance for accurate ink drop placement where the faceplate of the printhead is positioned to begin printing the surface area of the object that corresponds to the strip in the 3D map. (block 220). This minimum distance is determined with reference to all of the inkjets in the printhead if the area to be printed is flat and is determined with reference to only one or a few inkjets over the highest point in the area if the area to be printed is curved. At this printhead position, the process determines if any portion in the area in the strip opposite a nozzle in the printhead is greater than a predetermined maximum distance for accurate ink drop placement (block 224). If it is, then the area in the strip is removed from the identified strip in the 3D map (block 228). Once the portions opposite the inkjets in the area have been evaluated, then the process determines whether another area in the strip is to be evaluated (block 232). If another area is to be evaluated, the next area in the strip corresponding to the dimensions of the nozzle array in the faceplate is identified (block 236) and evaluated (blocks 220 to 232). When all of the areas of the identified strip have been identified as being printable or deleted from the strip (block 232), the process determines if another strip in the 3D map needs to be evaluated (block 240). A new strip in the cross-process direction away from the edge of the 3D map for the first strip and the first area are identified (block 244) and the next strip is evaluated (blocks 220 to 232). This processing continues until the process determines all of the strips in the 3D map have been evaluated (block 240). Each new strip evaluated after the initial strip is evaluated is a predetermined spatial shift from the immediately previously evaluated strip. This predetermined spatial shift is the width of one position in the cross-process direction in the 3D map in one embodiment, although other larger spatial shifts could be used, for example, to reduce the number of strips evaluated to conserve computing resources.

Once all of the strips on the 3D map have been evaluated and the areas having a portion outside the maximum distance for accurate ink drop placement or a portion closer than the minimum distance for accurate ink drop placement are deleted from the map, the remaining 3D map of the surface area on the object that can be printed is displayed on user interface 80 (block 248). Through the user interface, the user inputs the area on the displayed 3D map in which an image is to be printed and the content of the image (block 252). The controller generates the commands for operating the articulated arm to move the printhead along a path where the printhead can print the image at the identified area (block 256). The controller operates the articulated arm and the printhead to print the image on the object on the area of the object corresponding to the identified area in the displayed 3D map (block 260). After the printing is completed (block 264), the object is removed from the system 10 (block 268). As used in this document, the term "can be printed" means a surface area of an object, all of which is within the maximum distance for accurate ink drop placement and is no closer than the minimum distance for accurate ink drop placement when a faceplate of a printhead is opposite that surface area. As used in the discussion of this process and elsewhere in this document, the term "maximum distance for accurate ink drop placement" means the maximum distance between the nozzle of an inkjet of a printhead and the surface of an object opposite the nozzle at which the inkjet can accurately eject an ink drop for image formation and the term "minimum distance for accurate ink drop placement" means the minimum distance between the nozzle of an inkjet of a printhead and the surface of an object opposite the nozzle at which the inkjet can accurately eject an ink drop for image formation.

Figure 3:
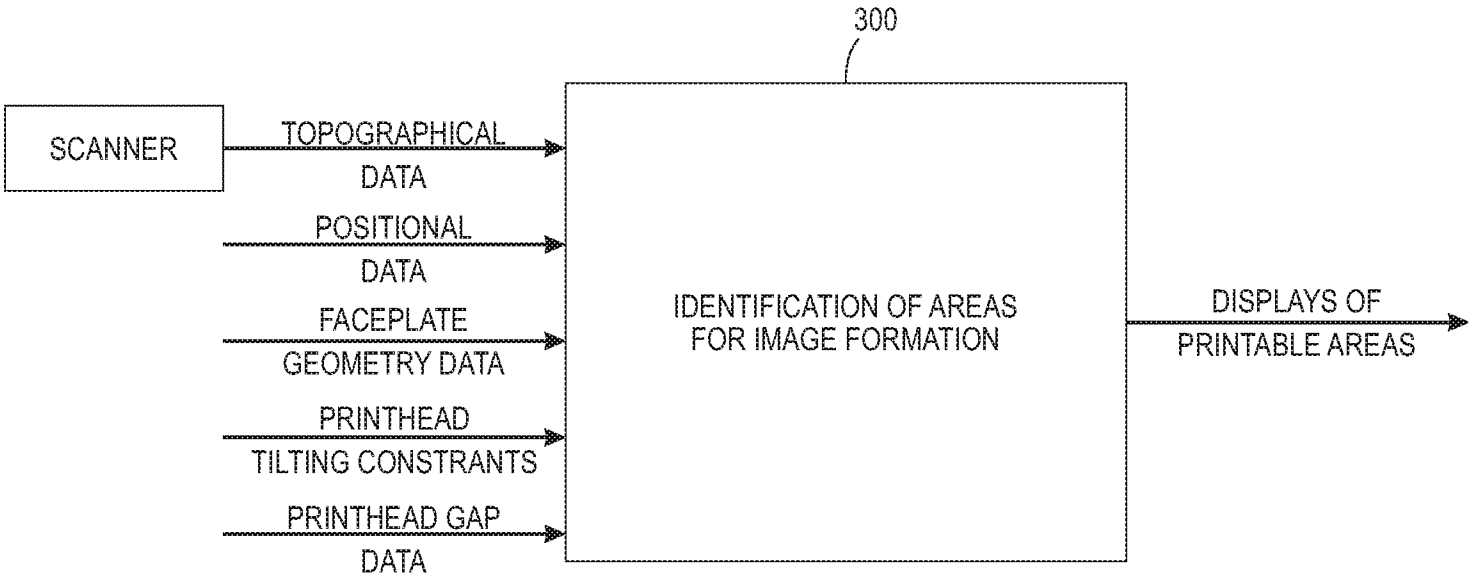
FIG. 3 is a block diagram for the area identification performed by the process of FIG. 2.
Figure 4A:
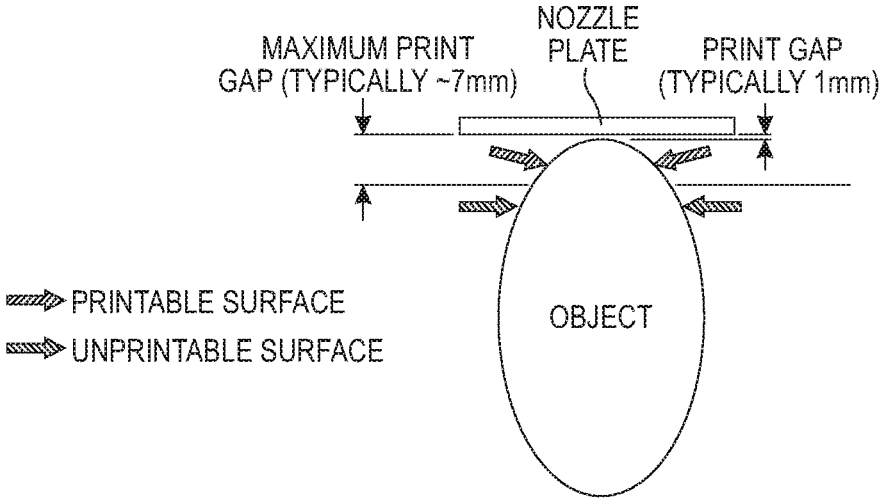
FIG. 4A, FIG. 4B, and FIG. 4C depict scenarios where a portion of an object to be printed is either too convex, too concave, or both too convex and too concave to be printed.
Figure 4B:
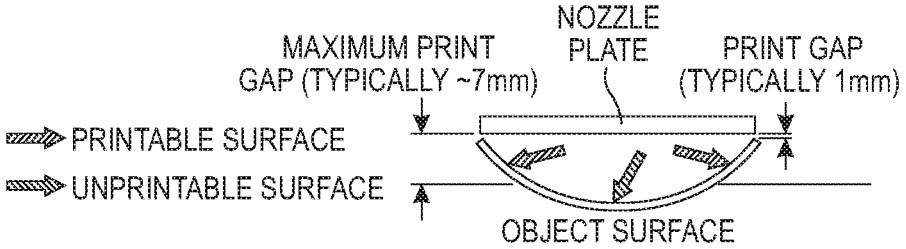
Figure 4C:
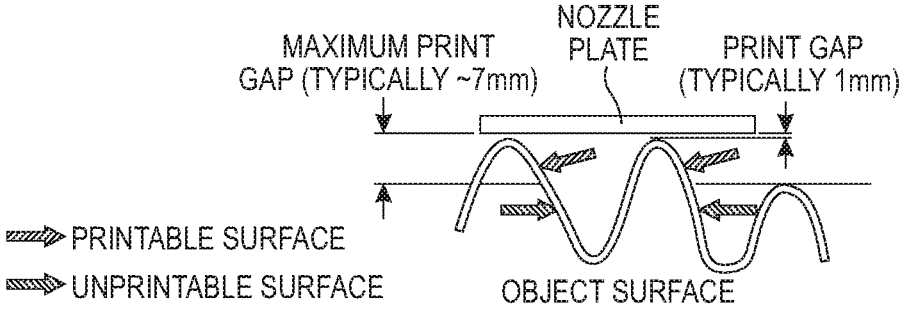

In more detail and with reference to FIG. 3, the process for identification of the areas for image formation 300 has a set of inputs and a set of outputs. The inputs include the topographical data of the object surface generated by the scanner, the positional data used to position the scanner over the surface of the object, faceplate geometry data, constraints on the tilting of the printhead, and data for an envelope of where the printhead faceplate can be placed with respect to the surface of the object. The outputs of the identification process in FIG. 3 are the visuals representations of the possible printhead trajectories over the surface of the object displayed on the user interface. The flatness criteria used to evaluate portions of the object's surface are the constant minimum distance between the position of at least one inkjet in the faceplate of the virtual printhead and the object surface and the calculated distances between the remaining inkjets in the faceplate of the virtual printhead and the object surface. The constant minimum distance, or print gap as it is also known, is chosen to be a constant parameter, typically 1 mm, and is maintained for the at least one position on the faceplate throughout all of the distance comparisons. If a data position in the 3D map is at a distance that is greater than the maximum distance, then the surface is too convex (FIG. 4A) or too concave (FIG. 4B) or both (FIG. 4C) to be printed. The minimum and maximum distance is determined using the angle of the faceplate relative to the surface portion being imaged, the distance between the inkjets opposite the heights of the surface portion at the angle of the faceplate, and the distance between the inkjets opposite the depths of the surface portion at the angle of the faceplate.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An object printer comprising:

a printhead having a planar nozzle plate with inkjets that are parallel to one another and perpendicular to the planar nozzle plate, the printhead being configured for movement in three-dimensional space;

a scanner configured to generate topographical data of a surface of an object opposite the scanner;

a first articulated arm to which the printhead is mounted, the first articulated arm having at least one servo that is configured to move the printhead with six degrees of freedom within the three-dimensional space; and a controller operatively connected to the printhead, the at least one servo of the first articulated arm, and the scanner, the controller being configured to:

receive the topographical data from the scanner;

generate a three-dimensional map of the surface of the object using the topographical data from the scanner;

store the three-dimensional map in a memory operatively connected to the controller;

identify a first strip in the three-dimensional map stored in the memory;

determine whether any inkjet in the printhead is outside a maximum distance for accurate ink drop placement from an area in the first strip when the printhead is moved to a position opposite a surface area of the object that corresponds to the area in the first strip where no inkjet in the printhead is closer than a minimum distance for accurate ink drop placement;

delete the area in the first strip from the three-dimensional map stored in the memory when any portion of the surface area of the object corresponding to the area in the first strip is outside the maximum distance for accurate ink drop placement when the printhead is moved to the position opposite the surface area corresponding to the area in the first strip where no inkjet in the printhead is closer than a minimum distance for accurate ink drop placement;

compare the maximum distance for accurate ink drop placement to distances between nozzles of the inkjets in the planar nozzle plate of the printhead and portions of the surface area of the object that are opposite the nozzles of the inkjets when the printhead is moved to the position opposite the surface area that corresponds to the area in the first strip where no inkjet in the printhead is closer than a minimum distance for accurate ink drop placement;

determine that the surface area that corresponds to the area in the first strip can be printed by the printhead positioned opposite the surface area that corresponds to the area in the first strip where no inkjet in the printhead is closer than a minimum distance for accurate ink drop placement when all the distances between the nozzles of the inkjets and the portions of the surface area of the object that are opposite the nozzles of the inkjets are within the maximum distance for accurate ink drop placement;

identify a plurality of additional areas in the first strip in a process direction;

determine whether each additional area in the plurality of additional areas in the first strip can be printed when the printhead is moved to a position opposite the surface area of the object that corresponds to each additional area;

delete each area from the first strip in the three-dimensional map stored in the memory that cannot be printed when the printhead is moved to the position opposite the surface area of the object that corresponds to the additional area that cannot be printed;

identify another strip in the three-dimensional map stored in the memory that is shifted from the first strip by at least one data position in the three-dimensional map in the cross-process direction;

identify a plurality of areas in the other strip;

determine whether each area in the plurality of areas in the other strip can be printed when the printhead is moved to a position opposite the surface area of the object that corresponds to each area in the plurality of areas in the other strip;

delete each area from the other strip in the three-dimensional map stored in the memory that cannot be printed when the printhead is moved to the position opposite the surface area of the object that corresponds to the area in the other strip;

identify additional strips in the three-dimensional map that are shifted from a previous strip by at least one data position in the three-dimensional map in the cross-process direction;

determine whether each area in each of the additional strips can be printed when the printhead is moved to a position opposite the surface area of the object that corresponds to each area in each of the additional strips;

delete each area from the additional strips in the three-dimensional map stored in the memory that cannot be printed when the printhead is moved to the position opposite the surface area of the object that corresponds to the area in one of the additional strips;

display the three-dimensional map stored in the memory on a user interface after all of the strips in the three-dimensional map have been identified and all of the areas in each strip have been removed from the three-dimensional map that cannot be printed when the printhead is moved to the position opposite the surface area of the object that corresponds to the area;

receive input from the user interface that identifies the areas in the displayed three-dimensional map that correspond to a surface area of the object where an ink image is to be printed;

operate the at least one servo of the first articulated arm to move the printhead in the three-dimensional space to positions opposite the surface area of the object corresponding to the identified areas; and operate the printhead when the planar nozzle plate of the printhead is opposite the surface area of the object corresponding to the identified areas to form an ink image on the surface area of the object corresponding to the identified areas.

2. The object printer of claim 1 further comprising:

a second articulated arm to which the scanner is mounted, the second articulated arm having at least one servo that is configured to move the scanner with six degrees of freedom within the three-dimensional space; and the controller is operatively connected to the at least one servo of the second articulated arm and the controller is further configured to operate the at least one servo of the second articulated arm to move the scanner in the three-dimensional space to positions opposite the object to generate the topographical data for the generation of the three-dimensional map.

3. A method for operating an object printer comprising:

generating topographical data with a scanner positioned opposite a surface of an object to be printed;

receiving with a controller the topographical data from the scanner;

generating with the controller a three-dimensional map of the surface of the object using the topographical data from the scanner;

storing the three-dimensional map in a memory operatively connected to the controller;

identifying with the controller a first strip in the three-dimensional map stored in the memory;

determining with the controller whether an area in the first strip is within a maximum distance for accurate ink drop placement when the printhead is moved to a position opposite a surface area of the object that corresponds to the area in the first strip where no inkjet in the printhead is closer than a minimum distance for accurate ink drop placement;

deleting with the controller the area in the first strip from the three-dimensional map stored in the memory when any portion of the surface area of the object corresponding to the area in the first strip is outside the maximum distance for accurate ink drop placement when the printhead is moved to the position opposite the surface area corresponding to the area in the first strip where no inkjet in the printhead is closer than a minimum distance for accurate ink drop placement;

comparing with the controller the maximum distance for accurate ink drop placement to distances between nozzles of the inkjets in the printhead and portions of the surface area of the object that are opposite the nozzles of the inkjets when the printhead is moved to the position opposite the surface area that corresponds to the area in the first strip where no inkjet in the printhead is closer than a minimum distance for accurate ink drop placement;

determining with the controller that the surface area that corresponds to the area in the first strip can be printed by the printhead positioned opposite the surface area that corresponds to the area in the first strip where no inkjet in the printhead is closer than a minimum distance for accurate ink drop placement when all the distances between the nozzles of the inkjets and the portions of the surface area of the object that are opposite the nozzles of the inkjets are within the maximum distance for accurate ink drop placement;

identifying with the controller a plurality of additional areas in the first strip in a process direction;

determining with the controller whether each additional area in the plurality of additional areas in the first strip can be printed when the printhead is moved to a position opposite the surface area of the object that corresponds to each additional area;

deleting with the controller each area from the first strip in the three-dimensional map stored in the memory that cannot be printed when the printhead is moved to the position opposite the surface area of the object that corresponds to the additional area that cannot be printed;

identifying with the controller another strip in the three-dimensional map stored in the memory that is shifted from the first strip by at least one data position in the three-dimensional map in the cross-process direction;

identifying with the controller a plurality of areas in the other strip;

determining with the controller whether each area in the plurality of areas in the other strip can be printed when the printhead is moved to a position opposite the surface area of the object that corresponds to each area in the plurality of areas in the other strip;

deleting with the controller each area from the other strip in the three-dimensional map stored in the memory that cannot be printed when the printhead is moved to the position opposite the surface area of the object that corresponds to the area in the other strip;

identifying with the controller additional strips in the three-dimensional map that are shifted from a previous strip by at least one data position in the three-dimensional map in the cross-process direction;

determining with the controller whether each area in each of the additional strips can be printed when the printhead is moved to a position opposite the surface area of the object that corresponds to each area in each of the additional strips; and deleting with the controller each area from the additional strips in the three-dimensional map stored in the memory that cannot be printed when the printhead is moved to the position opposite the surface area of the object that corresponds to the area in one of the additional strips;

displaying with the controller the three-dimensional map stored in the memory on a user interface after all of the strips in the three-dimensional map have been identified and all of the areas in each strip have been removed from the three-dimensional map that cannot be printed when the printhead is moved to the position opposite the surface area of the object that corresponds to the area;

receiving with the controller input from the user interface that identifies the areas in the displayed three-dimensional map that correspond to a surface area of the object where an ink image is to be printed;

operating with the controller at least one servo of a first articulated arm to which the printhead is mounted to move the printhead in the three-dimensional space to positions opposite the surface area of the object corresponding to the identified areas; and operating the printhead with the controller to form an ink image on the surface area of the object corresponding to the identified areas.

4. The method of claim 3 further comprising:

operating with the controller at least one servo of a second articulated arm to which the scanner is mounted to move the scanner in the three-dimensional space to positions opposite the object to generate the topographical data for the generation of the three-dimensional map.

* * * * *